US012546509B2

(12) United States Patent
Surwillo et al.

(10) Patent No.: US 12,546,509 B2
(45) Date of Patent: Feb. 10, 2026

(54) ADJUSTABLE AIR CONDITIONER BRACKET

(71) Applicant: Midea Group Co., Ltd., Foshan (CN)

(72) Inventors: Melissa Surwillo, Louisville, KY (US); Andrew Q. DeRossett, Shelbyville, KY (US)

(73) Assignee: Midea Group Co., Ltd., Foshan (CN)

( * ) Notice: Subject to any disclaimer, the term of this patent is extended or adjusted under 35 U.S.C. 154(b) by 224 days.

(21) Appl. No.: 18/362,500

(22) Filed: Jul. 31, 2023

(65) Prior Publication Data

US 2025/0043990 A1 Feb. 6, 2025

(51) Int. Cl.
*F24F 13/32* (2006.01)

(52) U.S. Cl.
CPC ..... *F24F 13/32* (2013.01); *F24F 2221/20* (2013.01)

(58) Field of Classification Search
CPC ..... F24F 13/32; F24F 2221/20; F24F 1/027; F24F 1/031; F24F 1/62; E04G 3/18; F16M 13/02; F16M 13/022
USPC ..... 248/208, 241; 182/62, 53; 454/204; 62/262
See application file for complete search history.

(56) References Cited

U.S. PATENT DOCUMENTS 2,560,467 A * 7/1951 Moore ..... F24F 1/04 62/297
2,717,139 A * 9/1955 Jewell ..... F24F 13/32 182/62
5,636,816 A * 6/1997 Burton ..... F24F 13/32 62/262
8,091,844 B1 * 1/2012 Bragg ..... F24F 13/32 248/220.21
8,167,260 B2 * 5/2012 Boccia ..... F24F 13/32 248/209
8,584,998 B1 * 11/2013 Peterson ..... F24F 13/32 182/62
9,163,854 B2 * 10/2015 Arbucci ..... E04B 1/388
9,303,895 B1 * 4/2016 Grant ..... F24F 13/32
D782,289 S * 3/2017 Darby ..... D8/380
9,605,870 B2 * 3/2017 Darby ..... F24F 13/32
10,203,130 B2 * 2/2019 Gardikis, Sr. ..... F24F 1/027
10,295,221 B2 * 5/2019 Zhang ..... F16M 13/02
11,168,920 B1 * 11/2021 Leezer ..... F24F 1/027
11,339,993 B2 * 5/2022 Zhao ..... F24F 13/32
11,397,023 B2 * 7/2022 Xing ..... F24F 1/62
11,397,024 B2 * 7/2022 Xing ..... F24F 1/0003
11,739,979 B2 * 8/2023 Leezer ..... F24F 13/32 248/208
12,038,196 B2 * 7/2024 Leezer ..... F24F 13/32
(Continued)

FOREIGN PATENT DOCUMENTS

CN 201476251 U 5/2010
CN 201628356 U 11/2010
JP 2005291677 A 10/2005

*Primary Examiner* — Ingrid M Weinhold
(74) *Attorney, Agent, or Firm* — Dinsmore & Shohl LLP

(57) ABSTRACT

An adjustable bracket for a window air conditioner is disclosed. The bracket includes a horizontal support member including an indoor portion and an outdoor portion. A vertical leg is removably coupled to the outdoor portion at various locations. An angled leg is removably and rotatably coupled to either the horizontal support member or to the vertical leg. A foot is removably coupled to either the angled leg or the vertical leg, depending on installation needs.

20 Claims, 10 Drawing Sheets

(56) References Cited

U.S. PATENT DOCUMENTS

| | | | | |
|---|---|---|---|---|
| D1,046,607 | S * | 10/2024 | Zhang | D8/380 |
| 2008/0164390 | A1* | 7/2008 | Walker | F24F 13/32 248/208 |
| 2009/0031744 | A1* | 2/2009 | D'Souza | F24F 1/027 62/262 |
| 2015/0097096 | A1* | 4/2015 | Arbucci | E04G 3/18 52/741.1 |
| 2018/0023842 | A1* | 1/2018 | Gardikis, Sr. | F16M 13/02 248/674 |
| 2019/0056143 | A1* | 2/2019 | Zhang | F24F 13/32 |
| 2021/0180828 | A1* | 6/2021 | Xing | F16M 13/022 |
| 2021/0325054 | A1* | 10/2021 | Zhao | F24F 13/32 |
| 2021/0341175 | A1* | 11/2021 | Leezer | F24F 13/32 |
| 2022/0057109 | A1* | 2/2022 | Leezer | F24F 1/027 |
| 2023/0026722 | A1 | 1/2023 | Yu et al. | |
| 2023/0213215 | A1* | 7/2023 | DeRossett | F24F 13/32 62/262 |
| 2023/0375222 | A1* | 11/2023 | Leezer | F24F 1/027 |

* cited by examiner

ADJUSTABLE AIR CONDITIONER BRACKET

BACKGROUND

The embodiments described herein relate to brackets for air conditioning ("AC") units, with particular embodiments shown for a window AC unit.

Typical window AC unit brackets include one or more horizontal outdoor bracket components on which the external portion of the AC unit sits, as well as one or more angled components that anchor against the exterior wall of the building or room in which the window AC unit is to be used. Some installations, however, involve a window that has a larger than standard outside ledge or some other object that interferes with the angled support leg of standard window AC brackets, and prevents it from making proper contact with the wall, preventing proper installation and support the unit. Other installations involve a roof section (either horizontal or slanted) that is located immediately below the window ledge. Standard AC brackets are not suited for these installations because either there is an object or obstacle associated with the window sill, or the angled support component has insufficient amount of vertical wall beneath the window ledge against which to anchor.

SUMMARY

The herein-described embodiments address these and other problems associated with the art by providing a window AC unit bracket that is adjustable in both length and height. The bracket includes a vertical support that allows the angled support to move incrementally up and down, allowing it to move below any large window ledge or obstruction. In the case of a roof or other surface directly below the window opening on the outside, the installer would have the option to use the roof as the supporting structure in place of an outside wall by removing the angled support leg from the assembly entirely, leaving the vertical support leg to contact the roof or other surface.

In some embodiments, a window air conditioner bracket is provided that includes a horizontal support bracket having an indoor portion and an outdoor portion; a vertical leg having a first end and a second end, wherein the first end of the vertical leg is configured to be removably coupled to the outdoor portion of the horizontal support bracket at varying locations along a length of the outdoor portion of the horizontal support bracket; an angled leg having a first end and a second end, wherein the first end of the angled leg is configured to be selectively rotatably and removably coupled to either the second end of the vertical leg or to the outdoor portion of the horizontal support bracket; and a foot that is configured to be selectively and removably coupled to either of the second end of the vertical leg or to the second end of the angled leg.

In some embodiments a window air conditioner bracket is provide that includes a horizontal support bracket having an indoor portion and an outdoor portion, wherein the indoor portion is configured to be fastened to a portion of a window opening and the outdoor portion extends outwardly from the window opening for receiving thereon an outdoor portion of an air conditioner, and wherein the outdoor portion has a plurality of openings therealong configured to receive a pin in any of the plurality of openings; a vertical leg having a first end and a second end, wherein the first end of the vertical leg is configured to be removably coupled via the pin to the outdoor portion of the horizontal support bracket at varying locations along a length of the outdoor portion of the horizontal support bracket; an angled leg having a first end and a second end, wherein the first end of the angled leg is configured to be rotatably and removably coupled to the second end of the vertical leg; and a foot that is configured to be selectively removably coupled to either of the second end of the vertical leg or to the second end of the angled leg.

In some embodiments a method of installing an air conditioner on a window bracket is provided, wherein the method comprises the steps of: providing a window bracket, wherein the window bracket has a horizontal support having an interior portion and an exterior portion; a vertical leg having a first end and a second end, wherein the first end is adjustably coupled along a length of the exterior portion of the horizontal support; an angled leg having a first end and a second end, wherein the first end of the angled leg is rotatably and removably coupled to either the second end of the vertical leg or to the horizontal support; and a foot configured to be selectively coupled to either the vertical leg or to the angled leg; placing the window bracket in a window opening above a sill, such that at least a portion of the exterior portion of the horizontal support extends outwardly from the window opening; fastening a portion of the interior portion of the horizontal support to a portion of the window opening; and placing a window air conditioner atop the horizontal support.

These and other advantages and features are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
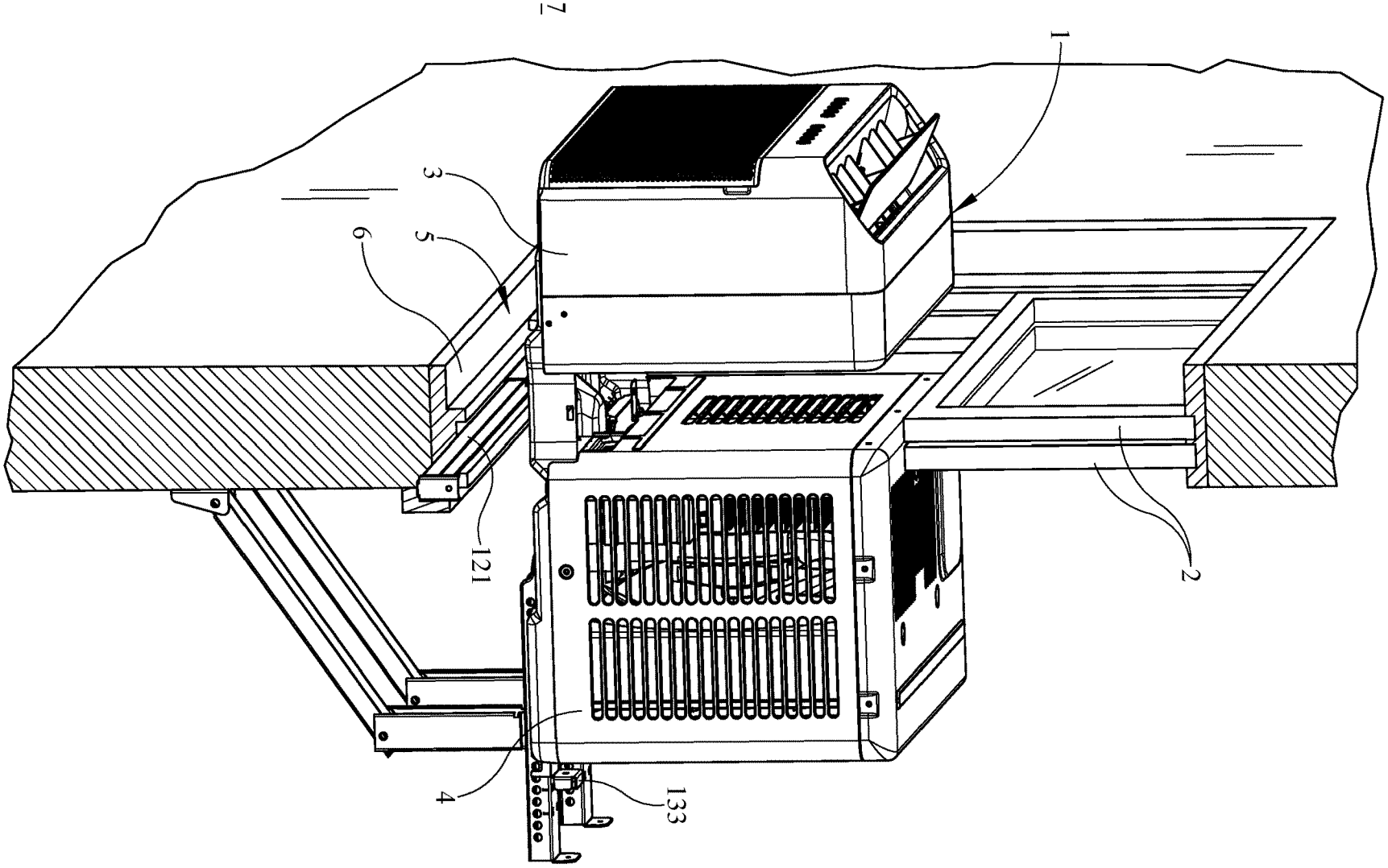
FIG. 1 is a partial cutaway perspective view of one type of window air conditioner resting on an adjustable bracket according to an embodiment.

Turning now to the drawings, wherein like numbers denote like parts throughout the several views, FIG. 1 illustrates one type of window air conditioner for use with the embodiments discussed herein. In FIG. 1, an embodiment of a bracket 100 is shown supporting a window air conditioner (AC unit) 1. The type of AC unit shown in FIG. 1 is a U-shaped AC unit wherein a sash of the window 2 can be brought downward between an indoor portion 3 of the AC unit and an outdoor portion 4 of the AC unit. However, this particular type of AC unit is not the only type that is usable with the embodiments disclosed herein. Rather, any common form of window AC unit can utilize the bracket 100 in its various embodiments. In a typical installation, the window AC unit resides in a window opening 5. The bottom portion of the window opening 5 is a sill 6. The indoor portion 3 resides on the interior side of the window 2 and communicates with the outdoor portion 4 to provide conditioned air to a room 7 on an interior side of the window 2. The components of the AC unit 1 are relatively heavy and must be supported by the bracket 100.

Figure 2:
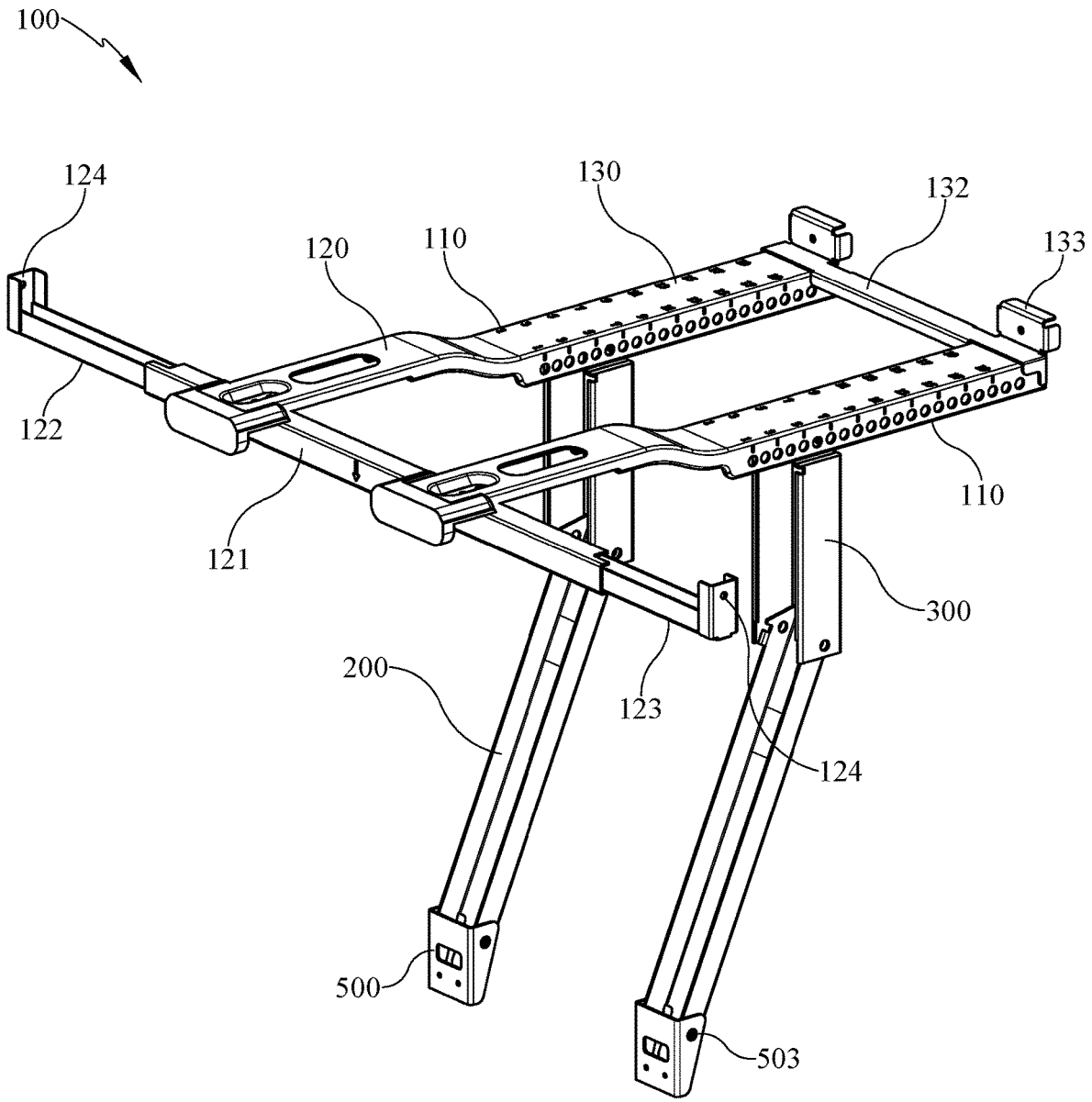
FIG. 2 is a perspective view of the bracket of FIG. 1, with the air conditioner removed for ease of viewing.

FIG. 2 illustrates an embodiment of the bracket 100 with the AC unit of FIG. 1 having been removed for ease of viewing. The bracket 100 includes a (i.e., at least one) horizontal support member 110 that extends in a substantially perpendicular orientation to the plane of the window 2. The horizontal support member 110 includes an indoor portion 120 and an outdoor portion 130. As installed, the indoor portion of the AC unit 3 sits on the indoor portion 120, and the outdoor portion of the AC unit 4 sits on the outdoor portion 130. The indoor portion 120 includes an interior cross support 121 coupled to the indoor portion 120 and oriented approximately perpendicularly thereto. The interior cross support 121 is therefore oriented approximately parallel to the plane of the window 2 and resides on or in the sill 6. The interior cross support 121 includes a first arm 122 and a second arm 123. Preferably first arm 122 and second arm 123 are extendible within or about interior cross support 121 such that the bracket 100 can be mounted in various sizes of window openings 5. Each arm 122, 123 includes one or more openings 124 for receiving fasteners (such as nails, screws, and the like) to fasten the interior cross support to the various structures of the window opening 5 (e.g., window track, casing, framework, and the like). Fastener openings 124 can be used to fasten the interior cross support 121 to the sill 6 and/or to the vertical structures of the window opening 5. The interior cross support 121 is depicted in the figures as made from a channel shaped section, which facilitates the extendibility of the first arm 122 and second arm 123 therein. However, this construction is not required, and any structural shapes commonly used for support arms of this nature are possible for these members.

In some embodiments, such as one embodiment depicted in the figures, the outdoor portion 130 can additionally include an outdoor end brace 132. The outdoor end brace 132 can be coupled to the outdoor portion 130 at or near the end of the outdoor portion 130 farthest from the window opening 5. The outdoor end brace 132 can include one or more upstanding portions 133. The upstanding portion 133 serves as a backstop or block to prevent the AC unit 1 from being able to slide off the terminal end of the horizontal support member 110, which would obviously be a dangerous situation. The outdoor portion 130 can also include, if desired, upstanding flanges 135 that can alternatively serve as a backstop either with or without use of upstanding portion 133.

Figure 3:
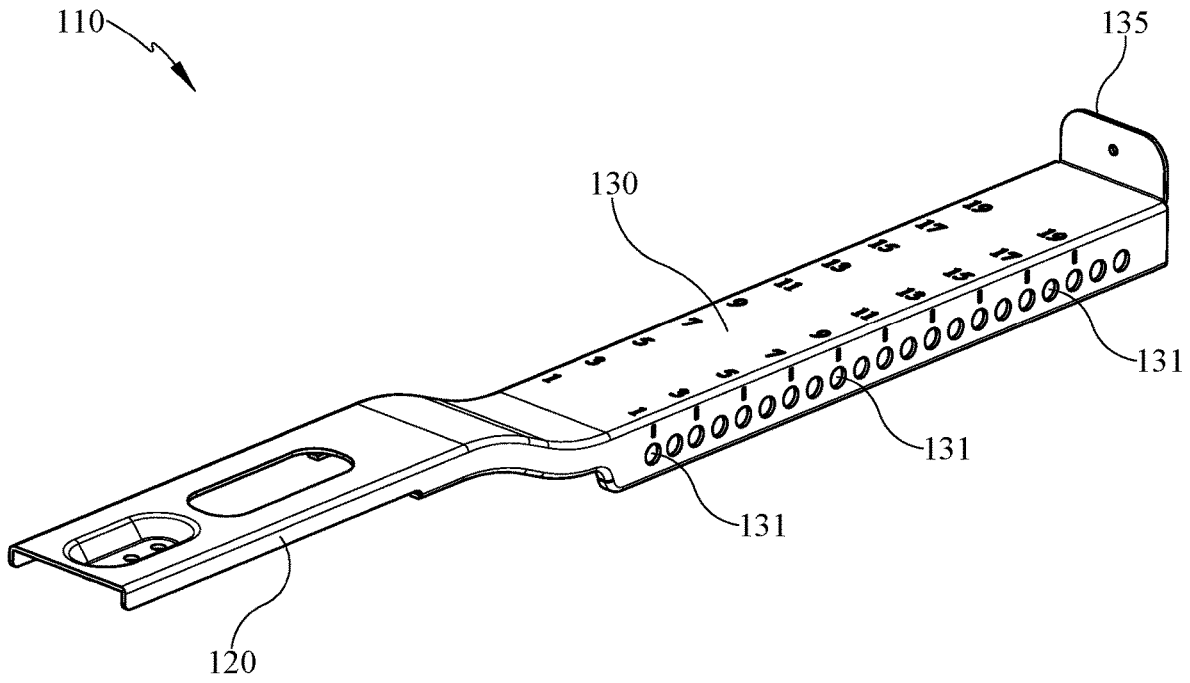
FIG. 3 is a perspective view of the horizontal support member of the bracket of FIG. 1.

With continued reference to FIG. 2 and reference to FIG. 3, in the embodiment shown in the figures, the horizontal support member 110 comprises two separate members. This, however, is not required, as the horizontal support member 110 could have fewer or more members, and indeed could be a plate. The aspect of importance is that the horizontal support member 110 have features thereon that facilitate removably and adjustably coupling thereto various legs (described below) at different locations horizontally away from the window opening 5. In the embodiment shown, the horizontal support member 110 includes outdoor portion 130 (either connected to or, as shown, integral with indoor portion 120) on which the outdoor portion 4 of the AC unit rests. The outdoor portion 130 includes multiple openings 131 spaced therealong at increasing distances away from the window opening 5. These fastener openings 131 receive pins 400 to secure one or more legs at desired locations along the outdoor portion 130 as will be explained below. The pin 400 can be any of the commonly known types of fasteners or connectors that engage or secure two structural items together, including but not limited to, keys, pins, clevis pins, safety pins, ring pins, other forms of securing pins, bolts, and the like.

Figure 4:
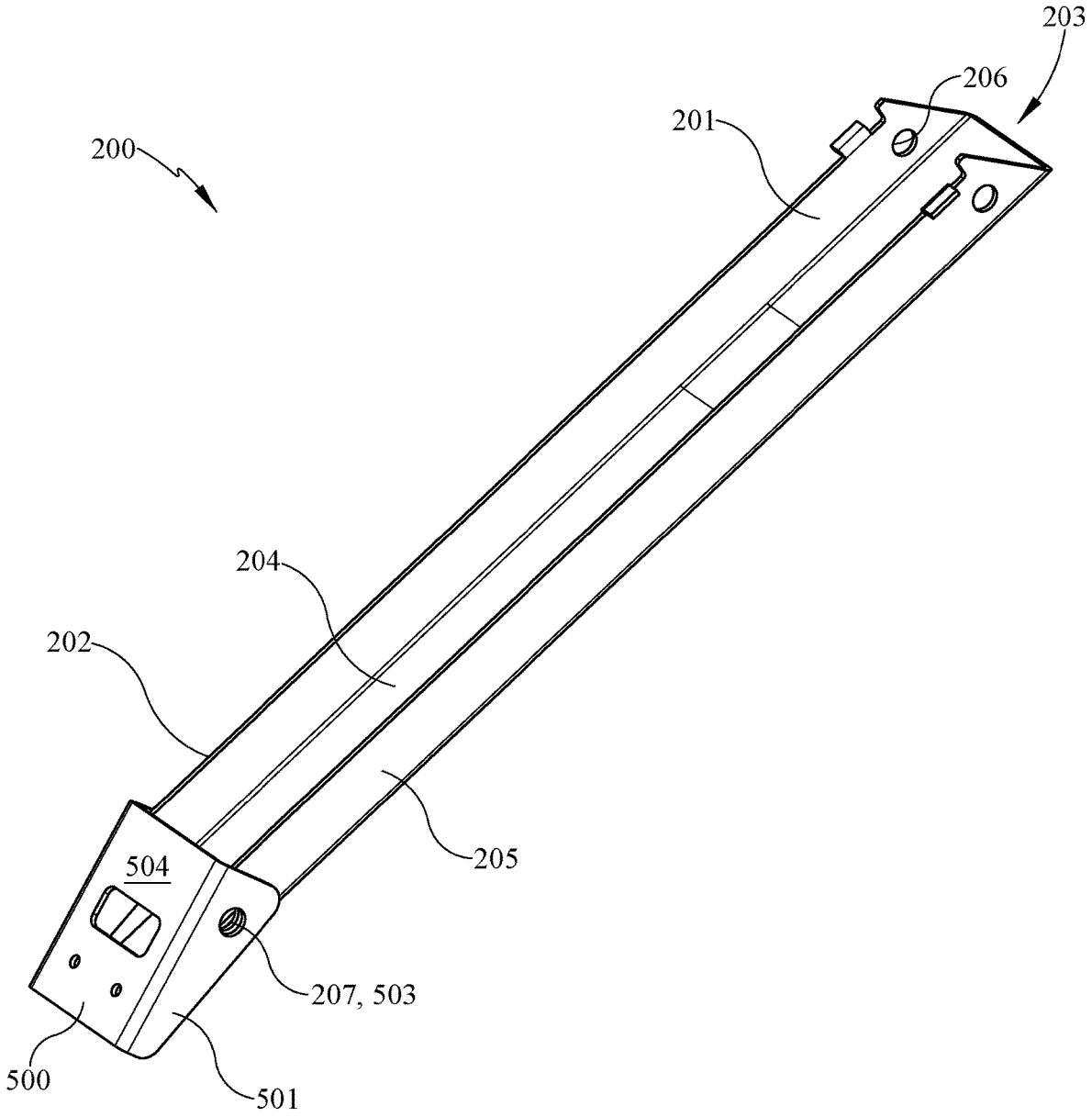
FIG. 4 is a perspective view of an angled leg of the bracket of FIG. 1 according to an embodiment.

With continued reference to FIG. 2 and reference to FIG. 4, the bracket 100 also includes an angled leg 200. Angled leg 200 has a first end 201 and a second end 202. Angled leg 200 in the embodiment shown is formed from a channel section having a basic U-shaped cross section with a channel interior 203 between upstanding flanges 204, 205 but, as stated, this particular shape of member is not required. First end 201 is configured to rotatably and releasably couple to other structures, such as either the outdoor portion 130 or the vertical leg 300 (discussed below). First end 201 includes openings 206 configured to receive a pin, and second end 202 includes openings 207 to receive a foot 500.

Figure 8:
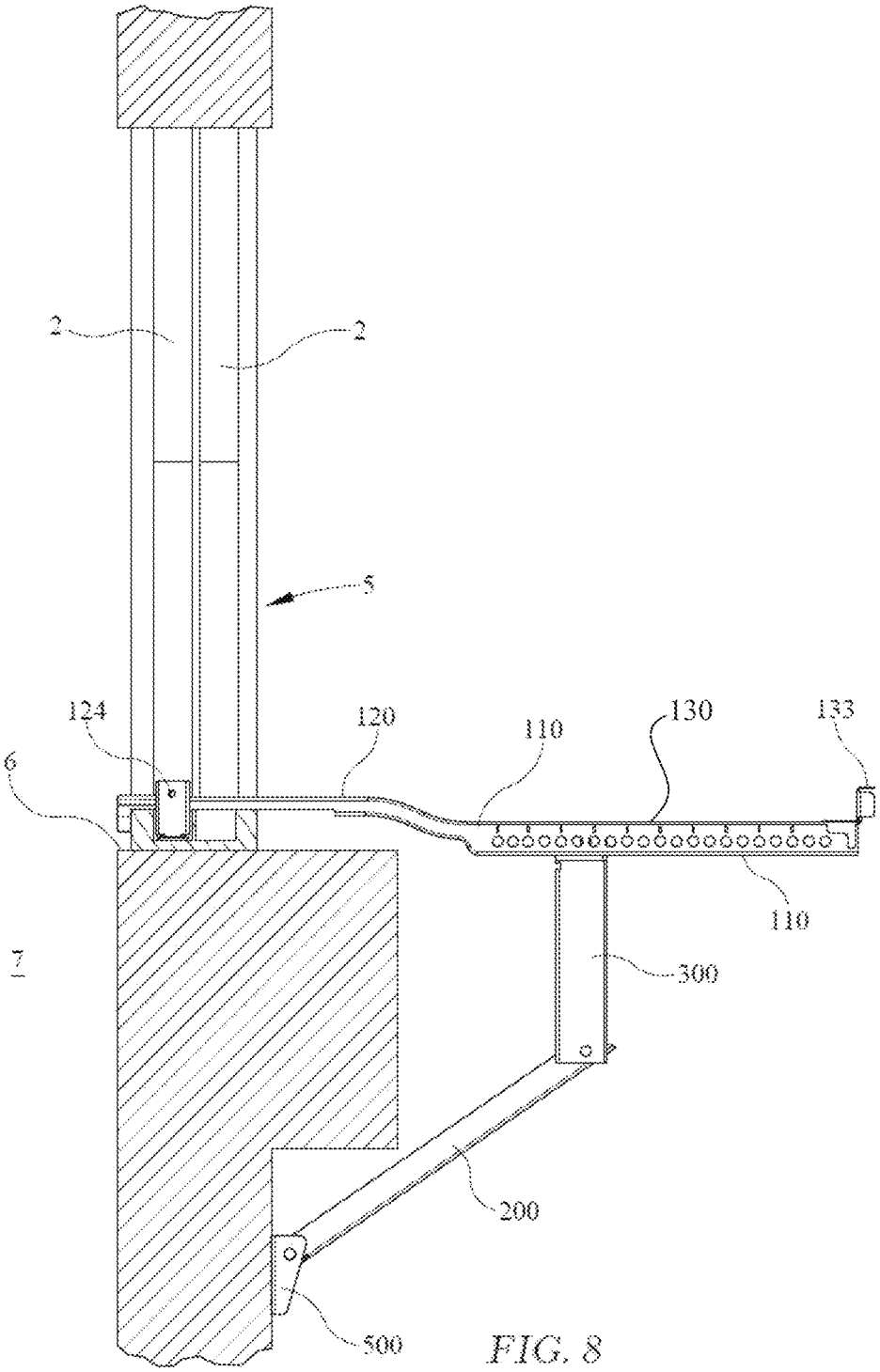
FIG. 8 is a side view of the bracket of FIG. 2 with the wall and window opening in section showing the bracket placed in a window installation having an oversized window sill.
Figure 9:
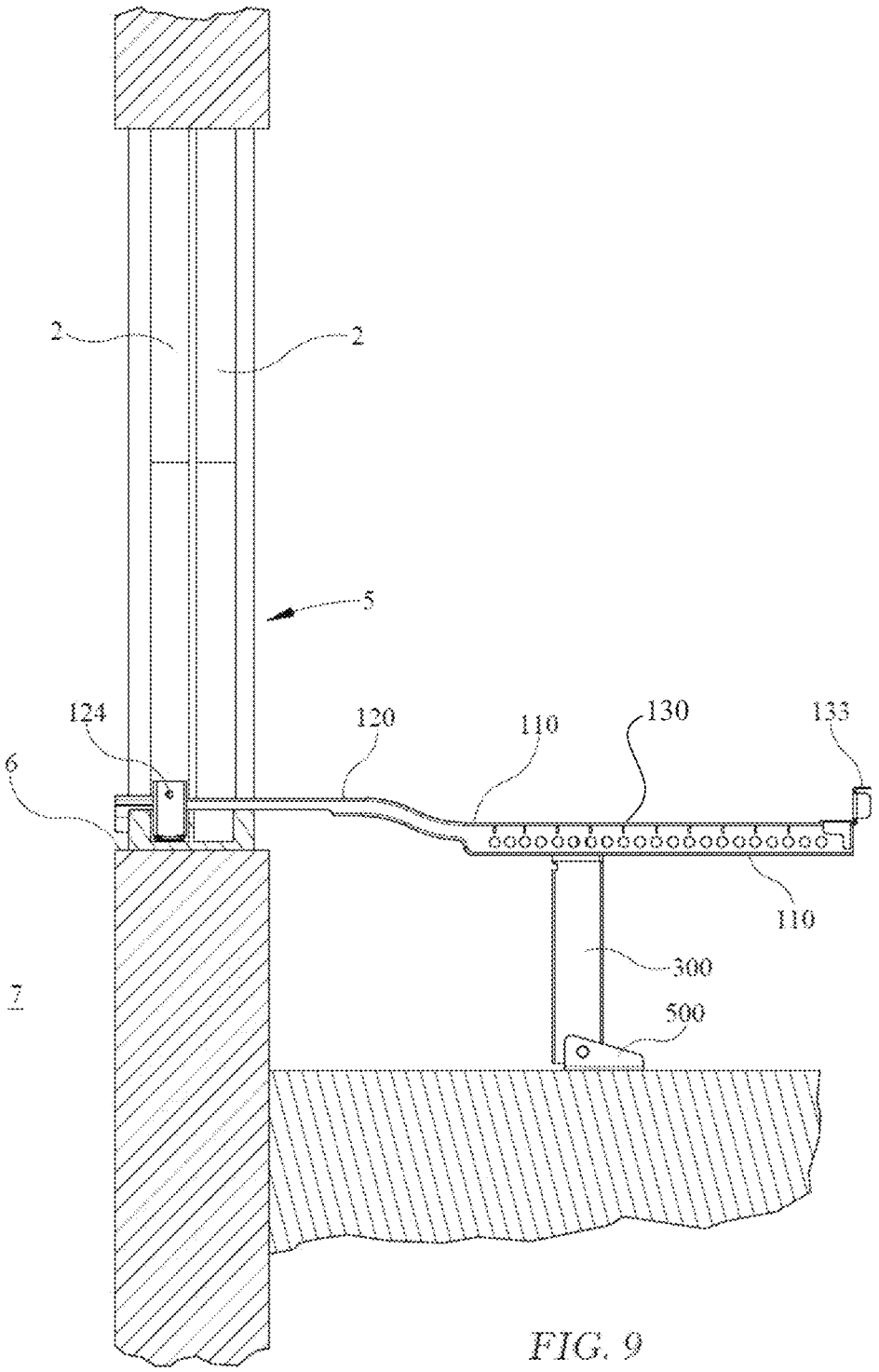
FIG. 9 is a side view of the bracket of FIG. 2 with the wall and window opening in section showing the bracket placed in a window installation having a roof below the exterior window sill.

In standard window AC unit brackets, angled supports such as angled leg 200 are typically coupled directly to horizontal members such as horizontal support member 110. As discussed previously, however, this arrangement does not accommodate many non-standard types of window installations. In one example, depicted in FIG. 8, some window openings 5 have oversized sills 6, or have sills that protrude outwardly beyond the normal outward distance or have an obstruction of some sort. In such instances, typical window AC unit brackets do not fit correctly (or indeed, cannot be used at all) in such installations because the angled supports either do not reach or do not adequately rest against whatever exterior vertical surface is below the sill 6 due to inadequate vertical reach. In another example, depicted in FIG. 9, some buildings that require window air conditioners have roof structures (e.g., a flat roof) located immediately below the sill 6. In these installations, the typical bracket cannot be used because there is not sufficient length of vertical exterior wall beneath the sill 6 for which the angled support to rest against. As a result of these deficiencies, the bracket 100 according to the embodiments shown herein includes a vertical leg 300 that is not only removable, but that also includes a foot that is removable and configured to alternately couple with the angled leg 200 as well. In FIG. 8 the bracket 100 uses both the vertical leg 300 and the angled leg 200. In FIG. 9, the bracket 100 does not use the angled leg 200.

Figure 5:
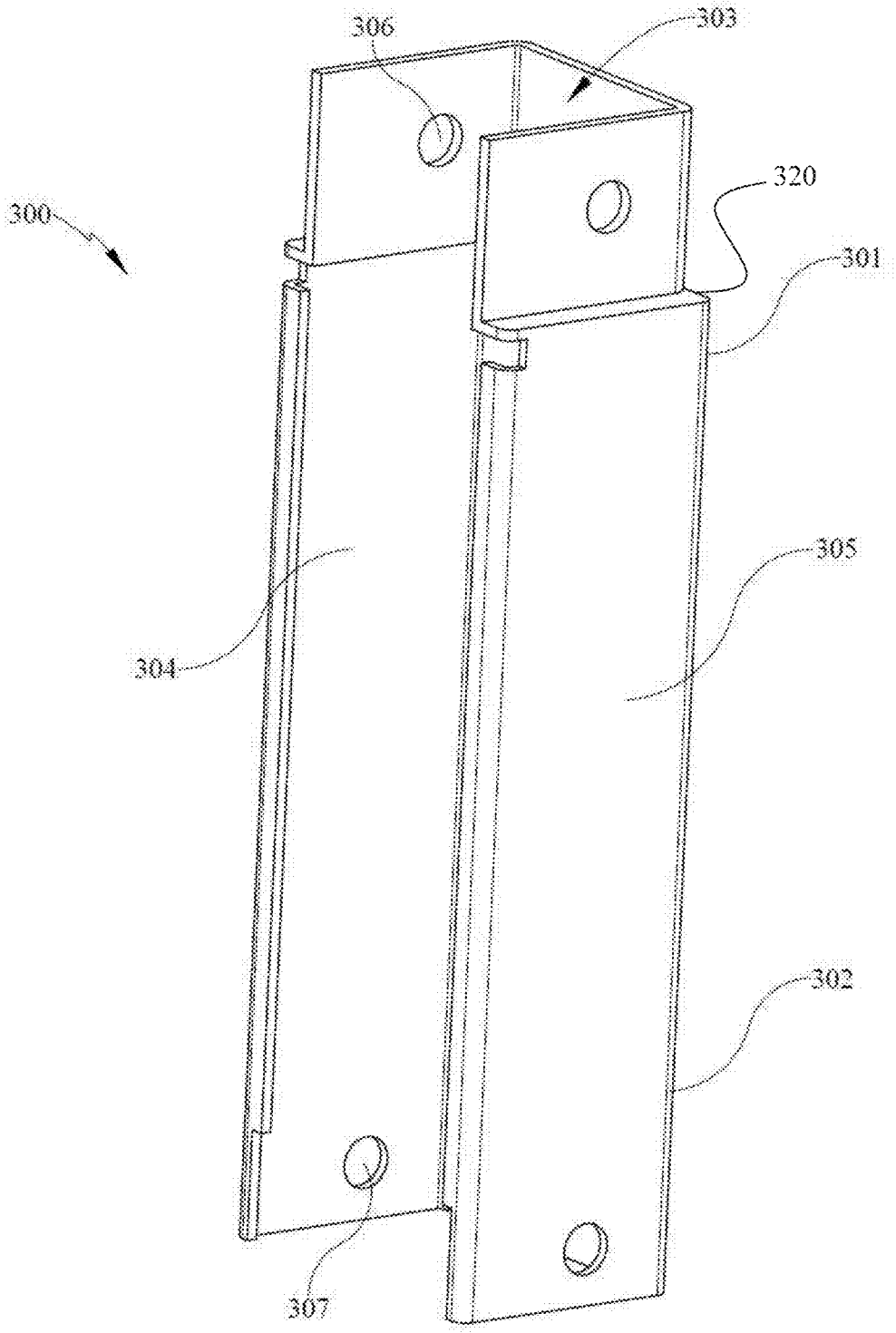
FIG. 5 is a perspective view of a vertical leg of the bracket of FIG. 1 according to an embodiment.
Figure 7:
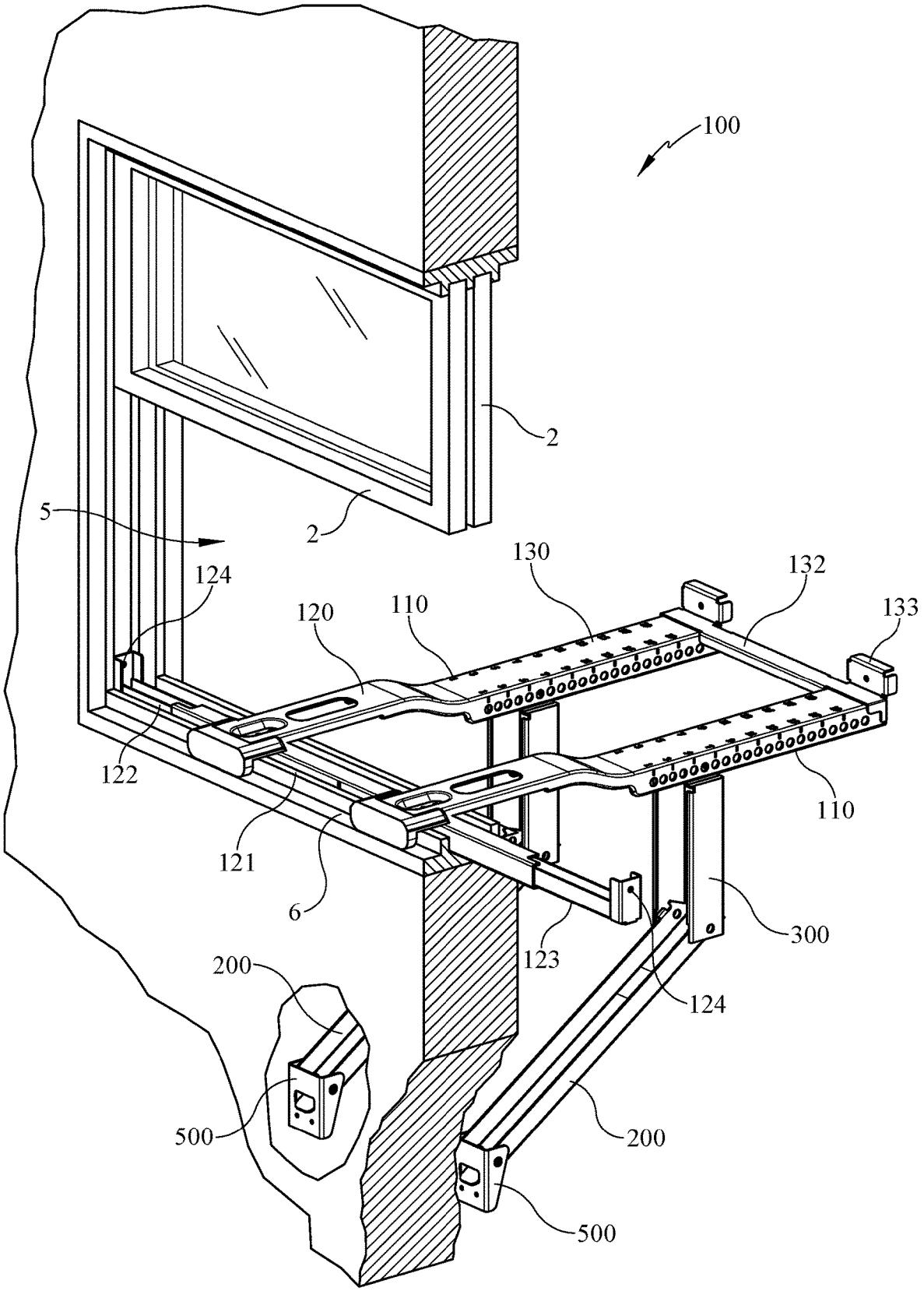
FIG. 7 is a perspective view of the bracket of FIG. 2 showing the bracket placed in a typical window installation.

With continued reference to Figures-FIGS. 2 and 7, and reference to FIG. 5, the vertical leg 300 includes a first end 301 and a second end 302. Vertical leg 300 in the embodiment shown is formed from a channel section having a basic U-shaped cross section with a channel interior 303 between upstanding flanges 304, 305, but, as stated, this particular shape of member is not required. First end 301 is configured to releasably couple to the outdoor portion 130. First end 301 includes openings 306 configured to receive a pin and includes a shoulder 320, and second end 302 includes openings 307 to receive either a foot 500 or the first end 201 of angled leg 200.

Figure 6:
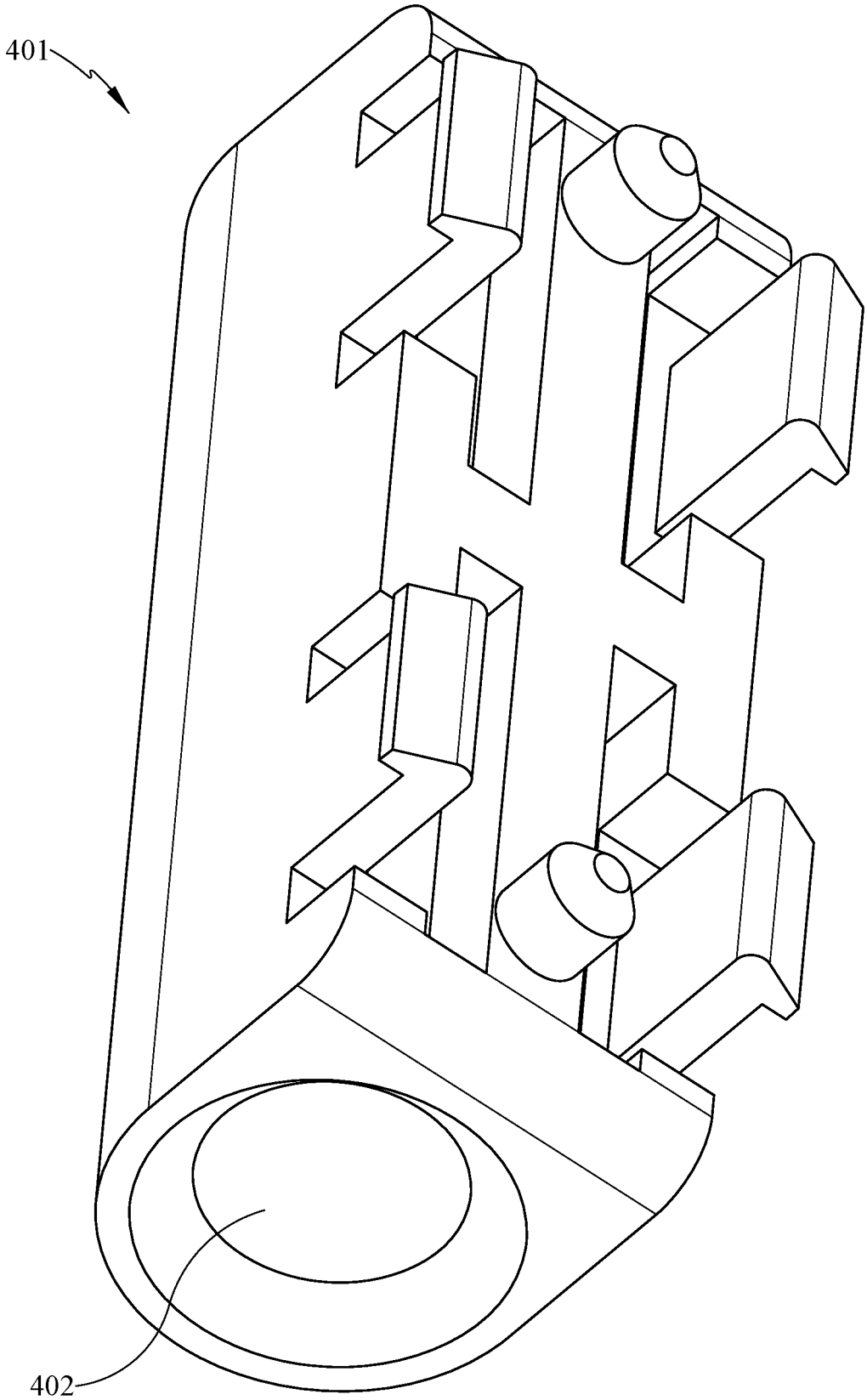
FIG. 6 is a perspective view of a pin carrier for a vertical leg of the bracket of FIG. 1 according to an embodiment.

FIG. 6 illustrates a pin carrier 401. The pin carrier 401 is placed within the channel interior 203 at the first end 201 of the angled leg 200. The pin carrier 401 includes a through-hole 402 that receives the pin. When the pin carrier 401 is so placed, the through-hole 402 lines up with, for example, opening 206 in the first end 201 of the angled leg 200 and with opening 307 in the second end 302 of the vertical leg 300. This makes it easier for a user to align the pin through each hole. A pin can then be inserted through these openings to secure the angled leg 200 to the vertical leg 300. Similarly, a pin carrier can be, if desired, used at either the first end 201 or the second end 202 of the angled leg 200, or both. Similarly, pin carrier can be, if desired, used at either the first end 301 or the second end 302 of the vertical leg 300, or both. Similarly, a pin carrier can, if desired, be used in other locations of the bracket 100 to facilitate insertion of the pin or other fastener.

With continued reference to FIG. 2, a foot 500 is shown at the second end 202 of the angled leg 200. The foot 500 is removably connected to the second end 202 at the opening 207. The foot 500 includes flanges 501 and 502 that form a U-shape, with an opening 503 therein. To connect the foot 500 to the angled leg 200, the opening 503 is aligned with opening 207 and a pin is inserted therethrough. The foot 500 can be, if desired, rotatable about the pin such that the foot 500 can assume various orientations with respect to the angled leg 200. The bottom of the foot 500 comprises a support surface 504. Support surface 504 is configured to rest against a portion of the building on which the bracket 100 is installed.

FIG. 9 illustrates a bracket 100 being used in an installation where there is a roof structure immediately beneath the sill 6. Beneficially, the foot 500 is removable by a user by simply removing pin from openings 503. For such installations, typical brackets cannot be used because there is no vertical external wall surface against which the foot of the angled support can push. The bracket 100 according to the embodiments described herein solves such problem. The angled leg 200 can be removed from the second end 302 of the vertical leg 300 by removing the pin. In similar fashion, the foot 500 can be removed from the second end 202 of the angled leg 200. Then, the foot 500 can be coupled to the second end 302 of the vertical leg 300 by aligning opening 503 of the foot 500 with opening 307 of the vertical leg 300 and inserting a pin therethrough. In this manner, the bracket 100 can then be supported by the vertical leg 300 with the foot 500 resting atop the horizontal surface of the roof (or other surface) the exists outside the window opening 5 and below the sill 6.

Figure 10:
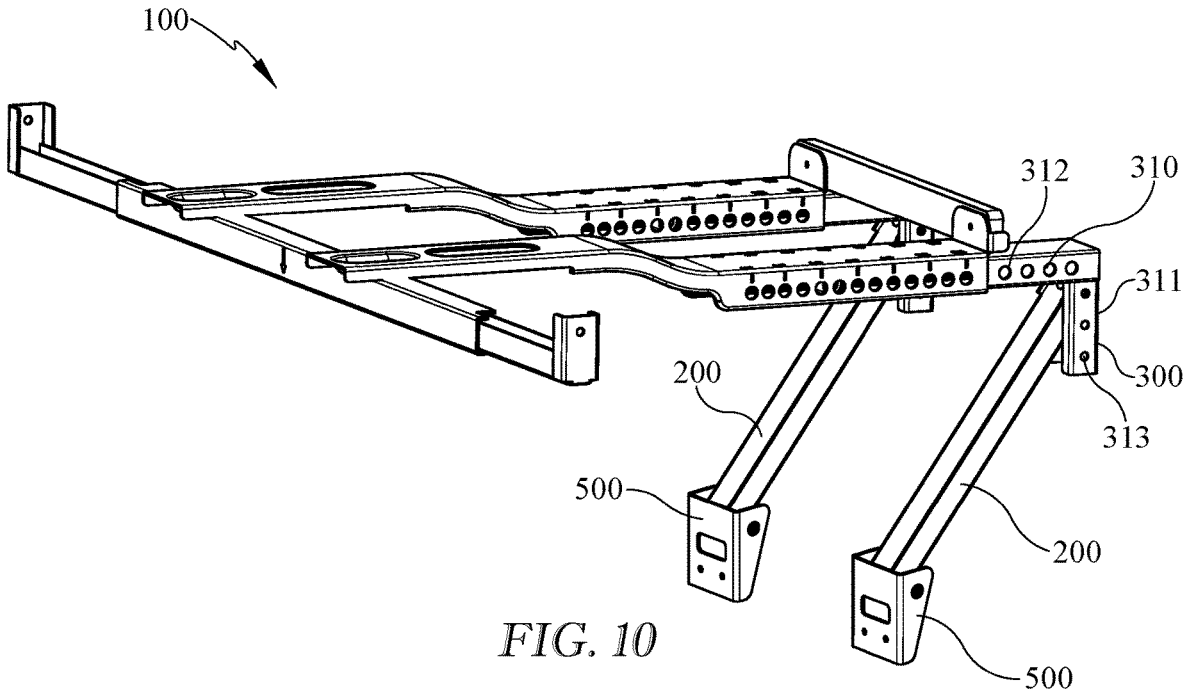
FIG. 10 is a perspective view of an alternative embodiment of the bracket showing the bracket configured for placement in a typical window installation.
Figure 11:
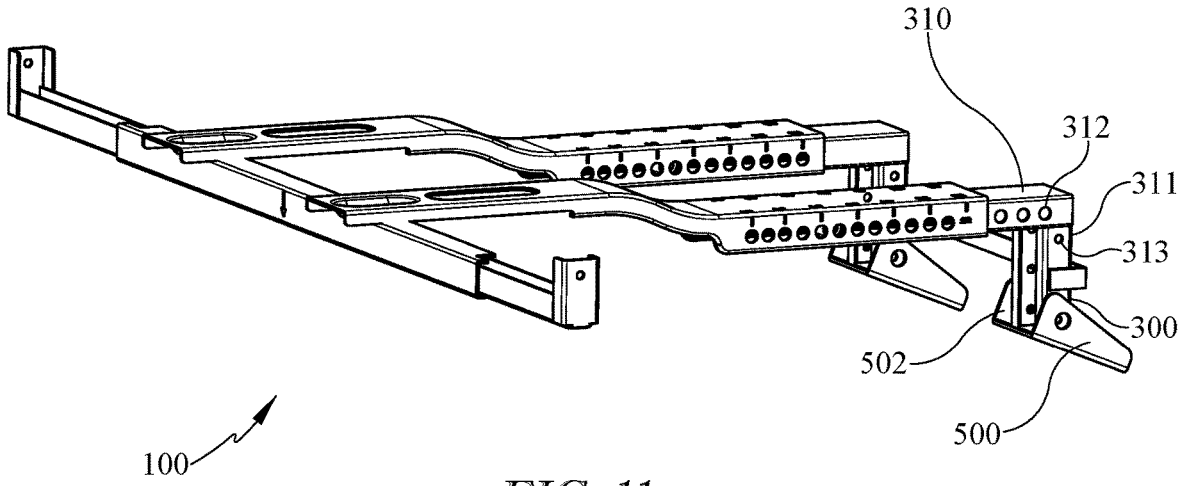
FIG. 11 is a perspective view of the bracket of FIG. 9 showing the bracket in a configuration for placement at a window installation with a roof beneath the window sill.

FIGS. 10 and 11 illustrate an alternative embodiment of the bracket 100. In this embodiment, the vertical leg 300 includes a horizontal component 310 such that the vertical leg 300 comprises an "L" shaped member having a horizontal component 310 and a vertical component 311. The horizontal component can have multiple openings 312 therealong, and the vertical component can have multiple openings 313 therealong. The overall length of the horizontal component 310 of the vertical leg 300, which length can be set to any desired length, coupled with the multiple openings 312 therealong can provide additional horizontal adjustment of the bracket 100 in a direction perpendicular to the window opening 5. The leg 300 can be coupled to the outdoor portion 130 of the horizontal support member 110 in the same or similar manner as is the leg 300 of the embodiment shown in FIGS. 1-9. As a result, the length of the outdoor portion 130 of the horizontal support member 110 can be shortened if desired for manufacturing, strength, or cost reasons.

With continuing reference to FIGS. 10 and 11, the vertical component 311 of the vertical leg 300 of this embodiment can additionally include openings 313 therealong. These openings 313 are configured to receive the first end 201 of the angled leg 200. The multiple openings 313 in the vertical leg 300 provide multiple connection point options for coupling the first end 201 of the angled leg 200 to the vertical leg 300. This provides great adjustability and numerous installation options for the bracket 100. It should be noted that the vertical leg 300 of the embodiment shown in FIGS. 1-9 optionally can also include multiple openings 313, in addition to opening 307. Also, the vertical leg 300 could itself be a telescoping leg that has length adjustability by telescoping within itself and inserting pins at desired lengths. It should also be noted that for either embodiment of vertical leg 300, the foot 500 can be attached to the vertical leg 300 at opening 307 or at any of the openings 313, to provide adjustability in the vertical direction for certain installations.

With continuing reference to the figures, various methods of installing the bracket 100 are possible. First, the user decides whether the AC unit 1 and bracket 100 will be supported against the exterior vertical wall beneath the window opening 5 (for typical installations), or whether it will need to be supported on a horizontal surface (e.g., a roof) beneath the window 2. For installations using the exterior vertical wall beneath the window opening 5, the angled leg 200 is used, with or without the vertical leg 300. For installations not using the exterior vertical wall beneath the window opening 5, the angled leg 200 is omitted and, instead, the vertical leg 300 is used.

The various steps described herein are not required to be followed in the specific order discussed. In typical installations, however, it is often helpful to inspect the window opening 5 and decide whether either or both of the vertical leg 300 and angled leg 200 will be needed. Once the user determines that, the user will couple the desired legs (either angled leg 200, vertical leg 300, or both) to the horizontal support member 110 by inserting one or more pins into desired openings in the various components that appear to provide an appropriate spacing and arrangement of the bracket 100. Once these preliminary positions of the various legs are made, the window 2 of the window opening 5 is opened. The bracket 100 is placed in the window opening 5 such that the outdoor portion 130 of the horizontal support member 110 extends exteriorly away from (perpendicular to) the window 2 and the indoor portion 120 extends into the room 7. The interior cross support 121 is placed on the sill 6. The first arm 122 and second arm 123 are extended to the desired width, such that the first arm 122 and second arm 123 can be secured to either or both of the sill 6 or other structures associated with the window opening 5 (e.g., the vertical casing of the window opening 5).

For installations using the vertical wall as support, as stated, the user decides (based on dimensions and spacing needed for the installation) whether the angled leg 200 should be connected directly to outdoor portion 130 of the horizontal support member 110, or whether it should be connected to the vertical leg 300. For installations where the angled leg 200 is connected directly to the outdoor portion 130, the vertical leg 300 is not required for the installation. In this case, the angled leg 200 is positioned such that the foot 500 that is coupled to the second end 202 of the angled leg 200 is resting against the exterior vertical wall below the window opening 5. If necessary, the angled leg 200 is moved horizontally along the outdoor portion 130 of the horizontal support member 110 and the opening 206 near the first end 201 of the angled leg 200 is aligned with the appropriate fastener opening 131 of the outdoor portion 130 of the horizontal support member 110. A pin is inserted through the openings 206, 131 (and, if included, through the through-hole 402 of the pin carrier 401) and appropriately secured with a securing lock 134. The securing lock 134 can be a removable locking structure that allows the pin to be removed if desired, and can include all commonly known devices to temporarily retain a mechanical structure in a desired location, including but not limited to, a nut, a cotter pin, a ring for a ring pin, other forms of locking pins, and the like to keep the pin secured in the openings 206, 131.

As stated above, some installations have an enlarged sill 6 or some other obstacle that would interfere with the foot 500 of the angled leg 200 if the angled leg 200 were connected directly to the outdoor portion 130. Such installations still might use the exterior vertical wall beneath the window opening 5 for support, but they require additional vertical distance between the foot 500 and the horizontal support member 110. For such installations the vertical leg 300 is coupled to the outdoor portion 130 of the horizontal support member 110 by aligning either one or more of openings 312 or opening 306 (depending on the embodiment) with the desired fastener openings 131 and inserting a pin through same (and, if included, through the through-hole 402 of the pin carrier 401). The angled leg 200 is connected to the vertical leg 300 by bringing foot 500 into contact with the exterior vertical wall below the window opening 5 and aligning the opening 206 at first end 201 of angled leg 200 with the opening 307 (or the desired opening 313, depending on the embodiment) in the vertical leg 300. A pin is inserted through the openings 206, 307 (or 313) (and, if included, through the through-hole 402 of the pin carrier 401) and secured therein with a securing lock 134. Again, as stated, if horizontal movement of the vertical leg 300 along the outdoor portion 130 of the horizontal support member 110 is required in order for foot 500 to be located against the vertical wall below the window opening 5, that is easy to do by removing pin, sliding vertical leg 300 to the desired location, aligning opening 306 with the desired opening 131, and inserting pin (with or without pin carrier 401) therethrough, and securing with a securing lock 134.

Alternatively, for installations having a horizontal roof or other structure beneath the window opening 5 such that the exterior vertical wall cannot be used to support the bracket 100, the user will remove the foot 500 from the angled leg 200 and place the foot 500 on the vertical leg 300. Specifically, the user removes the pin from the opening 207 of the second end of the angled leg 200 and opening 503 of the foot 500 to de-couple the foot 500 from the angled leg 200. The user then couples the foot 500 to the vertical leg 300 by aligning opening 503 with opening 307 (or 313) and inserting a pin therethrough (and, if included, through the through-hole 402 of the pin carrier 401) and securing with a securing lock 134. Again, horizontal relocation of the vertical leg 300 with respect to the outdoor portion 130 of the horizontal support member 110 is possible as discussed above, in order to locate the vertical leg 300 in the desired position and locating the foot 500 in its desired position resting on a horizontal (or non-vertical) exterior surface below the window opening 5.

Once the bracket 100 has been installed and the vertical leg 300 and foot 500 are in their desired locations, the AC unit 1 can be placed atop the bracket 100 and moved (by sliding, lifting, or otherwise positioning) into its proper location atop the bracket 100. The upstanding portion 133 prevents the AC unit 1 from sliding off the back of the bracket 100.

As stated above, the figures depict some particular embodiments of the bracket 100, but do not depict all the various alterations and modifications that can be employed. For example, additional brackets or bracing may be employed in various locations based on need. The sizes, shapes, sections, and materials for all components may vary depending on factors such as strength, manufacturability, cost, and so forth. More or fewer components than those depicted in the figures can be used for the various items referenced with reference numerals. The connections of the various elements described and depicted can be altered in ways that are commonly understood by persons skilled in the art. As but one example of the latter, the locations of the various openings and fastener pairs (e.g., opening 131 and pin) can be swapped. For example, instead of including a multitude of openings 131, outdoor portion 130 might include a multitude of pins. These pins could receive openings in the first end 201 of angled leg 200, or first end 301 of vertical leg 300. Substitutions such as these and others that are commonly known by artisans skilled in the art are not outside the scope and content of this disclosure and the claims appended hereto.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A window air conditioner bracket comprising:

a horizontal support bracket including an indoor portion and an outdoor portion; and selectively interchangeable components comprising:

a vertical leg having a first end and a second end;

an angled leg having a first end and a second end; and a foot;

wherein the window air conditioner bracket is convertible between first, second, and third configurations, wherein:

in the first configuration, said first end of said vertical leg is removably coupled to said outdoor portion of said horizontal support bracket at varying locations along a length of said outdoor portion of said horizontal support bracket, said first end of said angled leg is selectively rotatably and removably coupled to said second end of said vertical leg, and the foot is selectively and removably coupled to said second end of said angled leg such that the foot is supportable on a substantially vertical surface to support the window air conditioner bracket; and in the second configuration, said first end of said vertical leg is removably coupled to said outdoor portion of said horizontal support bracket at varying locations along a length of said outdoor portion of said horizontal support bracket, and the foot is selectively and removably coupled to said second end of said vertical leg such that the foot is supportable on a substantially horizontal surface to support the window air conditioner bracket; and in the third configuration, the first end of the angled leg is selectively and removably coupled to the horizontal support bracket, and the foot is selectively and removable coupled to the second end of the angled leg.

2. The window air conditioner bracket of claim 1, further comprising an interior cross support coupled to said indoor portion.

3. The window air conditioner bracket of claim 2, wherein said interior cross support further comprises an extendible arm configured to slide with respect to said interior cross support.

4. The window air conditioner bracket of claim 1, further comprising an outdoor end brace.

5. The window air conditioner bracket of claim 4, further comprising an upstanding flange.

6. The window air conditioner bracket of claim 1, wherein said vertical leg further comprises a plurality of openings therein configured to receive a pin.

7. The window air conditioner bracket of claim 6, wherein, in the first and second configurations, said first end of said vertical leg is coupled to said outdoor portion of said horizontal support bracket at one of said plurality of openings.

8. The window air conditioner bracket of claim 7, wherein, in the first configuration said first end of said angled leg is coupled to said vertical leg at one or more of said plurality of openings.

9. The window air conditioner bracket of claim 6, wherein said vertical leg further comprises a horizontal component.

10. The window air conditioner bracket of claim 9, wherein said horizontal component of said vertical leg further comprises openings therein configured to receive a pin.

11. The window air conditioner bracket of claim 10, wherein, in the first and second configurations, said vertical leg is coupled to said outdoor portion of said horizontal support bracket at said openings of said horizontal component of said vertical leg.

12. The window air conditioner bracket of claim 1, wherein said first end of said vertical leg fits within a channel interior of said outdoor portion of said horizontal support bracket, in the first and second configurations, and said vertical leg comprises a KKKK shoulder near said first end, said shoulder being approximately a same width as said outdoor portion of said horizontal support bracket.

13. A method of installing an air conditioner on a window bracket comprising the steps of:

providing a window bracket comprising:

a horizontal support bracket having an indoor portion and an outdoor portion; and selectively interchangeable components comprising:

a vertical leg having a first end and a second end;

an angled leg having a first end and a second end; and a foot;

placing said window bracket in a window opening above a sill, such that at least a portion of said outdoor portion of said horizontal support bracket extends outwardly from the window opening;

fastening a portion of said indoor portion of said horizontal support bracket to a portion of the window opening; and placing a window air conditioner atop said horizontal support, wherein the window air conditioner bracket is convertible between first, second, and third configurations, wherein:

in the first configuration, said first end of said vertical leg is removably coupled to said outdoor portion of said horizontal support bracket at varying locations along a length of said outdoor portion of said horizontal support bracket, said first end of said angled leg is selectively rotatably and removably coupled to said second end of said vertical leg, and the foot is selectively and removably coupled to said second end of said angled leg such that the foot is supportable on a substantially vertical surface to support the window air conditioner bracket; and in the second configuration, said first end of said vertical leg is removably coupled to said outdoor portion of said horizontal support bracket at varying locations along a length of said outdoor portion of said horizontal support bracket, and the foot is selectively and removably coupled to said second end of said vertical leg such that the foot is supportable on a substantially horizontal surface to support the window air conditioner bracket; and in the third configuration, the first end of the angled leg is selectively and removably coupled to the horizontal support bracket, and the foot is selectively and removable coupled to the second end of the angled leg.

14. The method of claim 13, further comprising, in the first configuration, the step of coupling said first end of said angled leg to said second end of said vertical leg; coupling said first end of said vertical leg to said horizontal support bracket; and coupling said foot to said second end of said angled leg.

15. The method of claim 14, further comprising, in the first configuration, the step of pivoting said angled leg to a desired angle with respect to said horizontal support bracket; moving said vertical leg horizontally along said outdoor portion of said horizontal support bracket to a desired location to bring said foot into contact with an outdoor surface of a building beneath the window opening; and fastening said vertical leg to said outdoor portion of said horizontal support at said desired location along said horizontal support bracket.

16. The method of claim 13, further comprising, in the second configuration, the step of coupling said first end of said vertical leg to said horizontal support bracket and coupling said foot to said second end of said vertical leg.

17. The method of claim 16, further comprising the step of moving said vertical leg horizontally along said outdoor portion of said horizontal support bracket to a desired location to bring said foot into a desired location over a horizontal outdoor surface below the window opening; and fastening said vertical leg to said outdoor portion of said horizontal support bracket at said desired location along said horizontal support bracket.

18. The method of claim 13, further comprising, in the third configuration, the step of coupling said first end of said angled leg to said horizontal support bracket and coupling said foot to said second end of said angled leg.

19. The method of claim 13, wherein said first end of said vertical leg fits within a channel interior of said outdoor portion of said horizontal support bracket, in the first and second configurations, and said vertical leg comprises a shoulder near said first end, said shoulder being approximately a same width as said outdoor portion of said horizontal support bracket.

20. A window air conditioner bracket comprising:

a horizontal support bracket including an indoor portion and an outdoor portion, said indoor portion configured to be fastened to a portion of a window opening and said outdoor portion extending outwardly from the window opening for receiving thereon an outdoor portion of an air conditioner, said outdoor portion having a plurality of openings therealong configured to receive a pin in any of said plurality of openings; and selectively interchangeable components comprising:

a vertical leg having a first end and a second end;

an angled leg having a first end and a second end; and a foot;

wherein the window air conditioner bracket is convertible between first, second, and third configurations, wherein:

in the first configuration, said first end of said vertical leg is removably coupled to said outdoor portion of said horizontal support bracket at varying locations along a length of said outdoor portion of said horizontal support bracket, said first end of said angled leg is selectively rotatably and removably coupled to said second end of said vertical leg, and the foot is selectively and removably coupled to said second end of said angled leg such that the foot is supportable on a substantially vertical surface to support the window air conditioner bracket; and in the second configuration, said first end of said vertical leg is removably coupled to said outdoor portion of said horizontal support bracket at varying locations along a length of said outdoor portion of said horizontal support bracket, and the foot is selectively and removably coupled to said second end of said vertical leg such that the foot is supportable on a substantially horizontal surface to support the window air conditioner bracket; and in the third configuration, the first end of the angled leg is selectively and removably coupled to the horizontal support bracket, and the foot is selectively and removable coupled to the second end of the angled leg.

* * * * *